United States Patent [19]

Pitto et al.

[11] 4,054,013

[45] Oct. 18, 1977

[54] METAL BEAM SYSTEM FOR STEEL-CONCRETE STRUCTURES

[76] Inventors: Ernesto Pitto, via G. Paganini 21/1; Giuseppe Borneto, via Corsica 14/11, both of Genoa, Italy

[21] Appl. No.: 673,097

[22] Filed: Apr. 2, 1976

[30] Foreign Application Priority Data

Apr. 14, 1975 Italy ..... 12568/75

[51] Int. Cl.[2] ..... E04H 12/18; E04B 1/343

[52] U.S. Cl. ..... 52/641; 52/641; 52/694; 52/645

[58] Field of Search ..... 52/639–644, 52/690–695, 393, 573, 648, 655, 657, 332, 632, 645, 646

[56] References Cited

U.S. PATENT DOCUMENTS

| | | | |
|---|---|---|---|
| 1,233,743 | 7/1917 | Arndt | 52/632 |
| 1,762,112 | 6/1930 | White | 52/694 |
| 1,776,467 | 9/1930 | Frandsen | 52/691 |
| 1,865,059 | 6/1932 | Ragsdale | 52/691 |
| 1,964,208 | 6/1934 | Leland | 52/640 |
| 3,456,415 | 7/1969 | Shaffer | 52/694 |
| 3,691,712 | 9/1972 | Bowling et al. | 52/573 |

FOREIGN PATENT DOCUMENTS

| | | | |
|---|---|---|---|
| 243,010 | 11/1960 | Australia | 52/632 |
| 74,421 | 12/1960 | France | 52/694 |

*Primary Examiner*—James L. Ridgill, Jr.
*Attorney, Agent, or Firm*—Jacobs & Jacobs

[57] ABSTRACT

A metal beam system for metal-concrete structure comprises one or two sinusoidal steel wires welded to a plate along one edge of the sinusoid and welded to two round steel bar stringers along the other edge. The round steel bar stringers are along the upper part of the sinusoid for principal and floor beams and along the lower part for the perimetrical beams.

3 Claims, 7 Drawing Figures

METAL BEAM SYSTEM FOR STEEL-CONCRETE STRUCTURES

The present application relates to a metal beam for steel-concrete structures.

Currently, various types of steel-concrete structures are commonly used in buildings and the like and, in said beams, the steel part may have different structures according to the building concept used. Owing to the high cost of labor and concrete forms, there is a tendency today to use metal parts suitable to be easily mass-produced, even in the building yard. These structures allow a simple and immediate installation, they are self-bearing and suport the weight of the concrete casting and they do not require supporting forms.

This type of structure is provided by the present invention. It consists, substantially, of one or two sinusoidal steel wires welded to a plate along one edge of the sinusoid and welded to two round steel bar stringers along the other edge. The round steel bar stringers are along the upper part of the sinusoid for principal and floor beams and along the lower part for the perimetrical beams.

Particular reference is made also to the construction of the headpieces of the principal, floor and perimetrical beams. Said system provides a safe bearing on the supporting beams or on the pillars, as well as free movement of the lower plate owing to expansion and flection and the possible compensation of the constructive tolerances, and it also provides a simple arrangement of the joining bars of the various headpieces of beams.

Such a system of construction provides simplicity and convenience in preparing the metal part of the beams, while the concrete casting can be made without supporting and without provisional operations such as boards, supports, tie-rods, etc.

The present invention is illusted in the accompanying drawing, in which.

Figure 1:
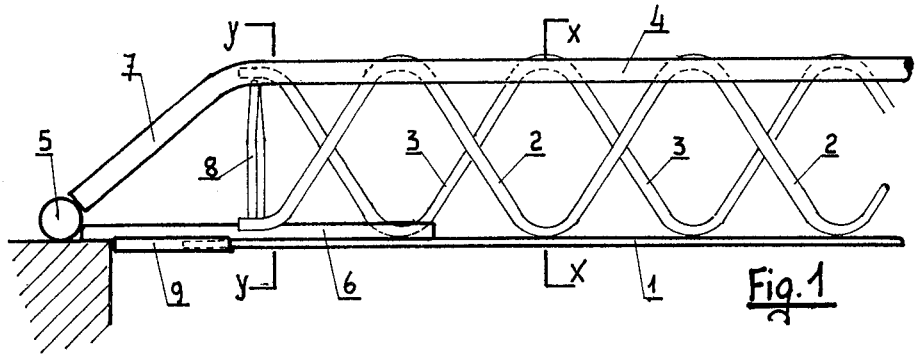
FIG. 1 is a side view of part of a principal beam of the present invention, with two sinusoidal wires.

With reference to FIGS. 1–4, a principal or floor beam according to the invention has a steel base plate 1 and two sinusoidal steel wires 2 and 3, with the lower wave of the sinusoid resting on and joined to plate 1 and the upper wave joined to two upper steel bars 4. This provides a metal beam for steel-concrete structures with a core having a triangular reticular shape, which is very strong, light in weight and easily prefabricated. Bottom plate 1 exceeds the width between the lower waves of the sinusoids of the two wires 2 and 3, in order to provide support for the forms containing the concrete casting.

The headpiece of the beam (in the drawing, only the left headpiece is indicated; the right headpiece will be the mirror image) has a round horizontal support rod 5, which is connected to plate 1 by two round trunks 6 and which is also connected to the ends 7 of the bars 4. The two wires 2 and 3 terminate in short horizontal ends of slightly less amplitude as compared to the maximum wave of the sinusoid (see FIGS. 1 and 4) and attached to these ends is a loop-shaped steel stiffening rod 8, which also connects the upper bars 4 with the lower trunks 6, thereby strengthening the upper bars 4 and allowing a certain reciprocal strain.

The joining of all the parts described above is by welding.

In order to compensate for the tolerances of the supporting structures and permit freedom of expansion and flection of plate 1, the plate itself is slightly spaced from the supporting structure and the air-space is covered by a sliding part 9, which can be easily moved toward the supporting structure.

The steel beam of FIGS. 1–4 can be used as a component of any steel-concrete beam, but it is preferably used for principal beams or floor beams. It is particularly characterized by an excellent resistance to torsional stress, owing to its unique triangular core.

Figure 5:
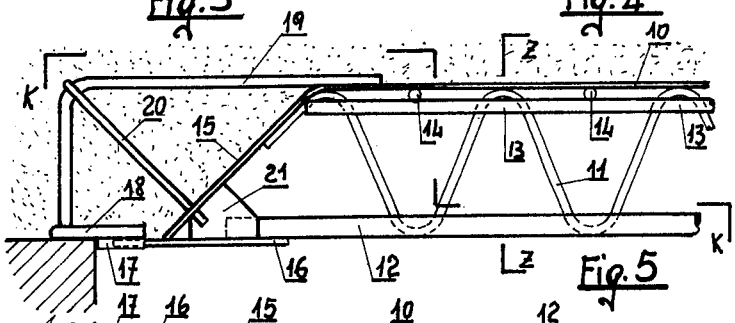
FIG 5 is a side view of a perimetrical beam having a sinusoidal vertical metal wire.
Figure 6:
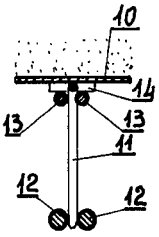
FIG. 6 is a section view of the beam along line Z—Z in FIG. 5.
Figure 7:
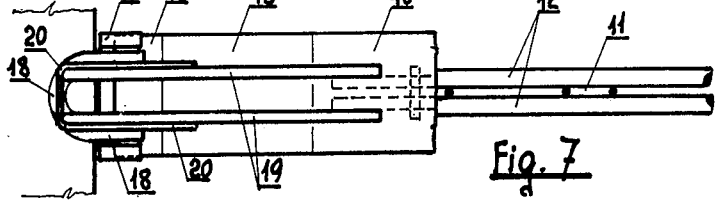
FIG. 7 is a partial top view along line K—K in FIG. 5.

The steel beam illustrated in FIGS. 5–7 is generally used for perimetrical beams, and it is constructed according to the same principle as the beam of FIGS. 1–4, but it is placed upside down, i.e. with the plate placed above and the rods below. Thus, the perimetrical beam of FIGS. 5–7 has an upper plate 10 and round sinusoidal steel wire 11 which is placed below the plate, with the upper wave of the sinusoid being welded to the plate and with the lower wave being joined to and stiffened by two lower steel bars 12. Near the upper wave of wire 11 there are two steel bars 13 which are joined to horizontal steel cross-bars 14 and which stabilize plate 10.

Figure 2:
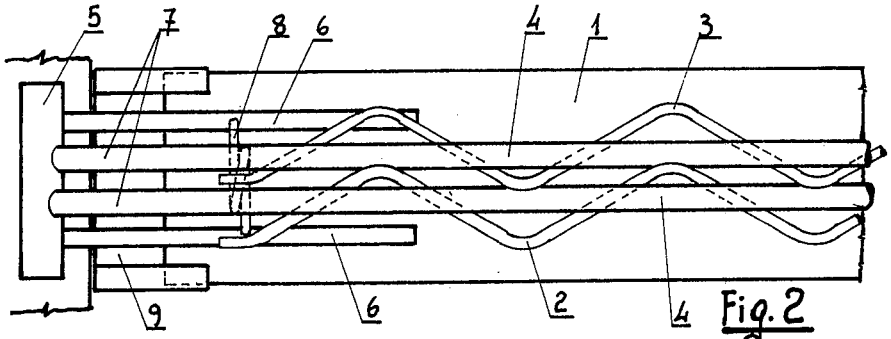
FIG. 2 is the top view of the beam illustrated in FIG. 1.
Figure 3:
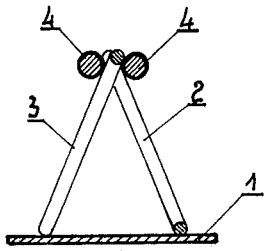
FIG. 3 is a section view of the beam along line X—X in FIG. 1.
Figure 4:
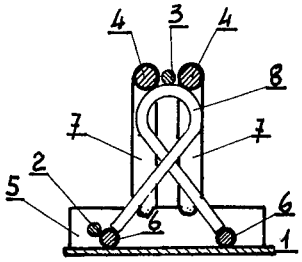
FIG. 4 is a section view of the beam along line Y-Y in FIG. 1.

The headpiece of the beam (in FIGS. 5 and 7 the left headpiece is shown, and the right headpiece is the mirror image) includes the downwardly bent end 15 of plate 10, which is connected at its end to plate 16, which in turn carries sliding part 17. Sliding part 17 has the same function as part 9 (FIGS. 1 and 2).

A horseshoe shaped steel bar 18 is connected to horizontal plate 16, to the supporting beam or the column, and to the upper part of plate 10 via a pair of L-shaped bars 19. A U bolt 20 connects bars 19 with the bent end 15 of plate 10. Two connection plates 21 strengthen the connection between the two lower bars 12 and the lower horizontal plate 16. The concrete casting is effected above plate 10 as shown, and the free space on both sides of the framework below plate 10 is conveniently used for pipelines, electric cables and other utilities.

The room thus prepared with the beams of the invention can be finished with the usual expedients, such as with wooden or metal panels. In the event that the above-mentioned perimetrical beams have to support the load of a prefabricated floor slab, it is advisable to arrange the core, always vertical, but off center, that is shifted inward of the floor, preferably in the point of conveyance of the loads from the floor to the beam, in order to eliminate any torsional stress.

Therefore, the present invention provides a special type of metal core for steel-concrete beams, and it can be easily prefabricated, it is simply assembled and makes the casting operation more simple.

What is claimed is:

1. A metal beam for steel-concrete structures, comprising an elongated plate, a pair of elongated sinusoidal metal wire means each having first and second curved portions on opposite sides thereof, the first curved portions of each wire means being spaced from each other and joined to opposite sides of the elongated plate, the second curved portions of both wire means being joined together to form a triangle having the wire means and the elongated plate as its sides, a pair of elongated bar means on either side of and joined to the second curved portions of each sinusoidal wire means, a metal rod means for supporting the metal beam spaced from each end of the plate and trunk means joining each rod means to the adjacent plate, the bar means terminating at each end in bent portions that are joined to said rod means, a slidable metal member at each end of said plate mounted for movement towards and away from said rod means to compensate for expansion and contraction of said beam, and a loop-shaped means for strengthening the bar means, said loop-shaped means being connected to the bar means at the loop portion and to the trunk means at the end portions thereof.

2. Apparatus according to claim 1, wherein the sinusoidal wire means terminate at each end in portions that are of slightly less amplitude than the curved portions.

3. Apparatus according to claim 1, wherein the width of the plate exceeds the spacing between the first curved portions of adjacent wire means.

* * * * *